United States Patent [19]

Stewart

[11] Patent Number: 4,764,986

[45] Date of Patent: Aug. 23, 1988

[54] WATERPROOF GARMENT FOR PATIENT WITH THORACIC INCISION

[76] Inventor: Karen D. Stewart, 1361 Council Bluff Dr., NE., Atlanta, Ga. 30345

[21] Appl. No.: 67,215

[22] Filed: Jun. 26, 1987

[51] Int. Cl.[4] ..... A41B 1/00

[52] U.S. Cl. ..... 2/115; 1/DIG. 6; 1/DIG. 7; 1/135

[58] Field of Search ..... 2/DIG. 7, DIG. 6, 114, 2/115, 8 L, 2.1 A, 73, 80, 135

[56] References Cited

U.S. PATENT DOCUMENTS

| | | | |
|---|---|---|---|
| 1,462,315 | 7/1923 | McElroy | 2/DIG. 7 |
| 1,489,046 | 4/1924 | Thompson | 2/DIG. 7 |
| 4,042,976 | 8/1977 | Reynolds | 2/135 |
| 4,055,855 | 11/1977 | Ragone et al. | 2/DIG. 7 |
| 4,258,440 | 3/1981 | McGowan | 2/DIG. 7 |
| 4,547,904 | 10/1985 | Long et al. | 2/135 X |
| 4,570,268 | 2/1986 | Freeman | 2/114 |
| 4,651,353 | 3/1987 | Walden | 2/DIG. 6 |
| 4,674,130 | 6/1987 | Coudron | 2/114 |

OTHER PUBLICATIONS

Velcro Product News, Nov. 1975, Pn No. 17.

*Primary Examiner*—Ronald Feldbaum

*Attorney, Agent, or Firm*—Jones, Askew & Lunsford

[57] ABSTRACT

A water resistant garment for protecting a thoracic incision on a patient during showering is disclosed. The garment includes upper and lower plackets extending completely through one sleeve, through the collar area of the garment, and all the way down one side of the garment which allows same to be fully opened on one side. This allows the garment to be placed on a patient with virtually no backward or upward movement of the patient's arms. Hook and eye fastening strips are used along the edges which are formed to join the plackets to selectively join the portions of the plackets when the garment is worn. A water seal is formed by a pair of absorbant cotton web panels extends from the collar area of the garment down the front and back of the body portion of the garment. This seal absorbs any water which enters the interior of the body portion of the garment. A selectively adjustable neckband flap has one strip of hook and eye fastening material, with a complementary strip disposed around an appropriate portion of the outer edge of the collar, for creating a snug seal around the neck of the user during use.

9 Claims, 2 Drawing Sheets

WATERPROOF GARMENT FOR PATIENT WITH THORACIC INCISION

TECHNICAL FIELD

This invention relates to the field of waterproof garments usable by surgical patients and more particularly discloses an improved waterproof garment particularly useful for allowing a patient with a thoracic incision to take a shower while keeping such incision dry.

BACKGROUND OF THE INVENTION

It is well known that most patients who have undergone any form of serious surgery must keep the area of the surgical incision dry for an extended period of time until the incision adequately heals. Getting water on a surgical incision slows the process of scar tissue formation and healing. Additionally, water can carry significant amounts of bacteria to the incision which can cause infection. This is particularly true in the case of bath and shower water wherein the water runs over other parts of the patient's body prior to contacting an incision.

Therefore it has been the uncomfortable experience of many surgical patients to have to forego normal bathing for a week or more after surgery.

In recognition of this problem, the prior art has produced protective covers usable for certain surgical patients to allow showering. For example, U.S. Pat. No. 4,009,494 to Nusbaum discloses a rectangular sheet like material with overlapping ends sealable with a hook and eye type fastener such as Velcro. The upper edge of the sheet is attached to a flexible rubber rod of circular cross section. At one extreme of the rod, it is reduced to a smaller cross section, and at the other extreme of the rod, it is bored out to accept the portion of smaller cross section.

In essence, the device disclosed in Nusbaum U.S. Pat. No. 4,009,494 is a rectangular wrap-around skirt with a rubberized seal in the waistband. It is disclosed as particularly useful for allowing colostomy patients to shower.

There is also considerable prior art in the general field of waterproof garments. Most waterproof garments for general use assume that a hat or umbrella will be provided to protect the head and neck area. One example of a waterproof garment having a side opening and what appears to be a relatively tight collar is shown in U.S. Pat. No. 570,081 to Beech. However, the garment shown in Beech has a side opening which extends from the bottom of the garment up to the area approximate one of the wearer's armpits and then in a curvilinear path from that point up to the center of the neck. Therefore, this garment must be put on in a manner using body motions of the same type that are normally used to put on any jacket.

Patients who have undergone thoracic surgery, such as open heart surgery, are subject to severely limited arm movements for a significant period of time after the surgery. The thoracic incision for heart surgery involves a major incision in the center of one's chest and separation of one or more ribs from the sternum. Therefore, any movement of the arms to any position in which the arm is raised, or tends to be swung toward the patient's back, is extremely painful (if at all possible) after such surgery. Therefore any protective garment for a patient having thoracic surgery is impractical if it requires the patient to raise his or her arms to any significant degree and move one or the other arms in a backward direction, such as the normal motion of the arms encountered as one puts on a conventional jacket.

Lying in the hospital, in an extreme amount pain without the ability to wash is a difficult experience for most people of western culture who are used to daily bathing as a part of their basic hygienic routine. Many people, particularly women, become extremely uncomfortable if they are unable to wash their hair for several days. It is well known that the ability to wash at least one's face and hair has a beneficial impact on many people's frame of mind and can make an unpleasant stay in a hospital recovering from major surgery more pleasant than it is under normal circumstances.

The protective article shown in the Nusbaum U.S. Pat. No. 4,009,494, discussed above, is impractical for protecting a thoracic incision. It is clear from inspection of the device that it is impractical to wrap it around one's neck. If the Nusbaum device were wrapped securely around a patient's chest just under their armpits, the normal cleavage on the human chest which lies at the sternum between the pectoral muscles would tend to channel water directly down the area of the chest over the sternum, directly to the location of the thoracic incision. In other words, an attempt to use the Nusbaum article to allow a patient with a thoracic incision to shower would tend to channel water directly on to the incision which should be kept dry. This problem could be exacerbated in the case of a woman as water would tend to run to the cleavage between a woman's breasts. However, the slightly depressed area between the pectoral muscles at the sternum on a line drawn between a human's armpits is a feature of men and women, and results primarily from the nature of the muscle structure on the ventral side of the human thorax.

Therefore, there is a need for a practical water resistant garment usable by patients who have undergone thoracic surgery to allow them to shower so that the face and hair may be washed. This need must be met by a practical garment which keeps water off of the patient's sternum during showering. Additionally, such a garment should be constructed so that it may be put on and taken off by the patient without the need to raise one's arms or more them toward his or her back. Generally speaking, the garment should be one which may be put on and taken off by the patient, with the assistance of another, with minimum required arm movement. Assistance may be obtained in washing the hair and face once the patient is able to enter the shower.

SUMMARY OF THE INVENTION

Broadly characterized the present invention is a waterproof garment formed generally in the shape of a conventional jacket which may be selectively opened and closed completely along one side on a line passing through the thoracic section, or body, of the garment, all the way to the neck opening. In other words, the garment is constructed so that it may be completely opened to accept the thorax of the wearer. In its preferred form the opening of one side of the garment extends through one sleeve.

More particularly, preferred forms of the present invention include an adjustable sealing element in the collar so that a tight seal may be formed around the patient's neck when the garment is worn. Naturally, under conditions of a shower water tends to adhere to the wearer's head and run down the wearer's neck to the area at which the collar of the garment contacts the neck. Therefore, the ability to form a relatively tight seal at this area is important.

It is recognized by the inventor that applying sufficient pressure at a person's neck, to assure that no water will pass through the neck/garment contact area, can lead to extreme discomfort and difficulty in breathing. Therefore, the preferred form of the present invention includes an interior lining beginning at or just below the collar portion of the garment to absorb the small amounts of water which may leak past the seal before such water is able to contact the thoracic incision. In the preferred form of the invention, this inner liner is made of an absorbant cotton material such as terry cloth.

The preferred form of the present invention employs hook and eye fasteners such as Velcro along the main side opening, the opening sleeve, and the neck area.

It is an object of the present invention to provide an improved waterproof garment usable by a person with a thoracic incision to allow the person to shower in a manner providing for complete washing of the person's head, without wetting the incision.

It is a further object of the present invention to provide an improved waterproof garment which the wearer may put on and take off with minimum movement of the person's arms.

It is a further object of the present invention to provide an improved water resistant garment usable by a patient with a thoracic incision having a water absorbant liner in the interior, to absorb water which leaks through the neck/collar contact area and prevent same from contacting the patient's incision.

It is a further object of the present invention to provide a garment of the type described above in which one side of the garment (at both the side wall, sleeve, and up to the neck opening) may be completely separated to allow the other non-opening sleeve to be placed on one of the wearer's arm and then to refasten the separated edges of the garment about the neck, chest, and other arm of the patient.

That the present invention meets these objects, and overcomes the above noted drawbacks of the prior art, will become apparent in the following description of the preferred embodiment of the invention.

DETAILED DESCRIPTION OF THE PREFERRED EMBODIMENT

Figure 1:
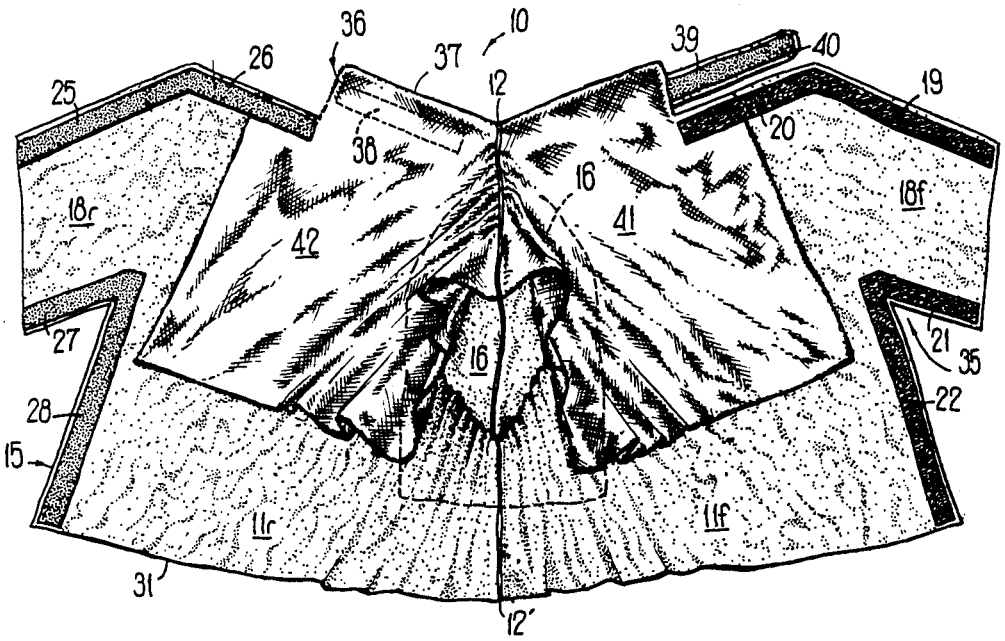
FIG. 1 is a plan view of the interior of the preferred embodiment of the present invention in its open position.
Figure 2:
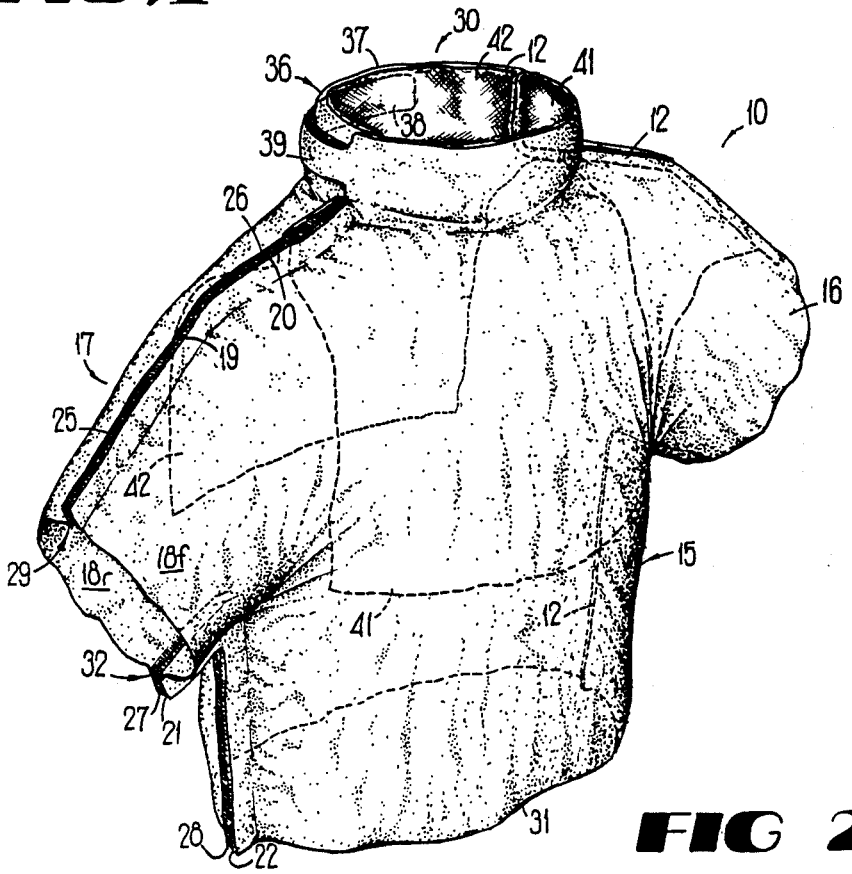
FIG. 2 is a pictorial view of the preferred embodiment in its closed and sealed configuration.

Turning now to the drawing figures which like numerals reference like parts, the preferred embodiment of the present invention will now be described. In FIG. 1, a plan view of the interior of the preferred embodiment 10 is shown, with the garment laid open. FIG. 2 shows a pictorial view of the preferred embodiment.

The material for making the outer portions of garment 10 can, as a general proposition, be any form of waterproof or water resistant flexible sheet like material. The preferred material for construction of embodiments of the present invention is a web of a waterproof vinyl polymer, preferable polyvinyl chloride, commonly known to the public as "vinyl". The inventor of the present invention used material cut from conventional vinyl shower curtains to construct prototypes which she has successfully used. However, other plastics, and polymeric web materials, polypropelene impregnated cotton, woven nylon, rubber, and many other waterproof or water resistant materials are appropriate for constructing embodiments of the present invention. Generally, the body portion 15 of the garment is constructed from a front panel section **11*f* and a rear panel section 11*r***.

Turning first to FIGS. 1 and 2, the physical construction of the preferred embodiment will now be discussed. Front and rear panels **11*f* and 11*r*, respectively, of body 15 are joined by seams 12 and 12'. In the preferred embodiment, a first sleeve 16, which is the left sleeve in the preferred embodiment, is stitched along seam 12 at the top of the sleeve seam 12' at the bottom of same, and thus remains permanently in the form a conventional sleeve. A second sleeve 17 is composed of a front panel portion 18*f* and a rear panel portion 18*r*. As seen in FIG. 1, front panel 18*f* has the hook elements of a hook and eye fastening material, preferably that of the type sold under the trademark Velcro, disposed on a strip 19 along the upper edge of the panel. Strip 19 extends along the upper edge of front sleeve panel 18*f* onto a strip in the shoulder segment shown at 20 in the drawing figures. A second strip of hook fastening material 21 extends along the lower edge of front sleeve panel 18*f* and continues as strip 22 down the side of front body panel 11*f***.

A similar strip 25 of the eye material extends along the upper edge of rear sleeve panel **18*r* and on through the rear side of the shoulder portion at 26. Also, strips of eye material 27 and 28 extend along the lower edge of rear sleeve panel 18*r* and the outer edge of rear body panel 11*r***, respectively.

As may be appreciated by inspection of FIGS. 1 and 2, hook material strips 19 and 20 mate with eye material strips 25 and 26, respectively, when the garment of the preferred embodiment is worn by the user. Similarly, hook, material strips 21 and 22 mate with eye material strips 27 and 28 to form a seal on the lower portion of sleeve 17 (FIG. 2) and down the left side of the body 15 of the preferred embodiment. From the foregoing description, it should be apparent that the junctions of strips 19, 20, and 25 and 26 form an upper placket extending from a point shown at 29 in FIG. 2 at the distal end of sleeve 17 all the way to neck opening 30 of the preferred embodiment. The junctions of strips 22 and 28 form part of a lower placket which extends from lower edge 31 of body 15 up to the armhole/sleeve area shown at 35 on FIG. 1. This lower placket further extends longitudinally along the entire length of sleeve 17 from the armhole/sleeve area 35 to a point 32 (FIG. 2) at the distal end of sleeve 17. The upper and lower plackets of the preferred embodiment, described immediately above, are constructed for allowing a side, and one sleeve of the preferred embodiment to open completely.

At the top of the preferred embodiment a collar 36 having an upper edge 37 is formed. One outside surface of collar 36 has a strip of hook fastening material 38 shown in phantom in FIGS. 1 and 2. A neckband flap 39 has a strip of eye fastening material 40 disposed on the inner surface thereof. As may be seen from inspection of FIGS. 1 and 2, collar 36 constitutes a neckband disposed around the periphery of neck opening 30. Fastening strip 38 is disposed at a first end of the neckband flap shown on the left hand side of FIG. 1. Neckband flap 39 is arranged to overlap the first end of the neckband, as shown in FIG. 2. Fastening strips 38 and 40 constitute means for selectively joining neckband flap 39 and the first end of the neckband at which strip 38 is connected.

Disposed within the interior of the preferred embodiment are two pieces of absorbant cotton material, commonly known as terry cloth, 41 and 42. These pieces form two absorbant webs which lay on the back and chest of the user when the garment is worn. Also, as may be best appreciated from inspection of FIG. 2, absorbant webs 41 and 42 extend up to the upper edge 37 of neck opening 30. Therefore, these upper portions of webs 41 and 42 disposed on the interior of collar 36 constitute a means for forming a water resistant seal about the neck of the user when the garment is worn.

As will be apparent to those skilled in the art and familiar with the use of water resistant clothing, the sealing function about the wearer's neck is preferably a trade off between tight compression of the neck area by a material disposed around the periphery of neck opening 30 along edge 37 and the ability to prevent the further flow of small amounts of water which may leak under edge 37 down the wearer's neck. It is, of course, possible to constrict the user's neck so tightly that little or no water will enter. However, this is extremely uncomfortable for the wearer. Also, since many users of this garment are people who have undergone open heart surgery, it is extremely unwise to do anything which might restrict such a patient's ability to breathe. Therefore, the neck sealing apparatus of the preferred embodiment is one which makes a trade off between a snug fit of upper edge 37 around the wearer's neck and providing water absorbant webs 41 and 42 to impede the flow of any water which actually runs down the user's neck on the inside of edge 37 to prevent it from contacting a thoracic incision.

In other words, it is not necessary to completely seal the neck area of the person from the entry of any water. It is only necessary to assure that, during the time one expects the patient to be under the shower where water is impinging on the upper edge 37 of collar 36, absorbant webs 41 and 42 will absorb sufficient water in the neckband area to prevent an excess amount of water from running down the length of web 41 thus wetting the patient's incision.

In constructing the preferred embodiment, the inventor has used Velcro strips manufactured with a preapplied adhesive backing to embody fastening strips 19, 21, 22, 25, 26, 27, 28, 38, and 40. The preferred embodiment uses stitched seams 12 and 12' to join body panels 11*f* and 11*r*, and the front rear halves of sleeve 16 together. However, it is not necessary that stiching be used. Any method of adequately securing the mating strips to the material of the garment, such as gluing, sewing, hot melt adhesives, welding, or the like, may be used. Similarly, it is not necessary to provide seam 12 and 12' and these are features only of the preferred embodiment and not limitations on the present invention. Naturally, more conventional constructions of a single piece of material from which panels 11*f* and 11*r* are formed, together with a sewn tubular sleeve attached at an armhole/sleeve seam area may be used. Similarly, any material which adequately impedes the flow of water below upper edge 37 of collar 36 may be used to implement the function of absorbent web panels 41 and 42 in embodiments of the present invention.

Likewise, there are a number of available alternatives for joining pieces of embodiments of the present invention together in addition to stiching. Since preferred embodiments are made of PVC plastic materials, gluing, heat welding, and ultrasonic welding are some of the possible methods of joining components of embodiments of the present invention.

Figure 3:
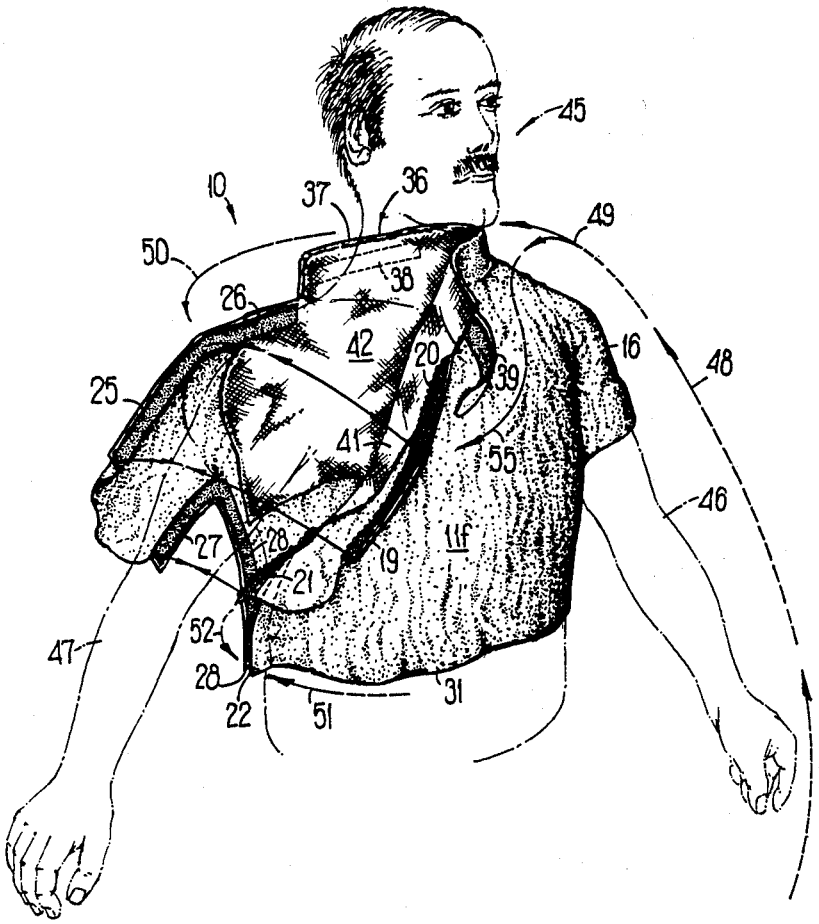
FIG. 3 is a pictorial view of the preferred embodiment being applied to a patient showing the relative motions of parts of the garment in the absence of any required motion from the patient.

FIG. 3 is a diagram indicating the sequence of steps for dressing a patient for entry into the shower using the preferred embodiment. FIG. 3 shows the garment of the preferred embodiment as partially applied to a patient 45. In FIG. 3, dashed arrows indicate movements of the garment pieces onto the patient which have already been accomplished prior to achieving the state of the garment depicted in the drawing figure. Solid arrows indicate movements of portions of the preferred embodiment yet to be accomplished in order to finish the application of the garment to the patient. Patient 45 has a left arm 46 and a right arm 47. Note that the patient's arms 46 and 47 are held in a downwardly pointed position close to the patient's torso.

When the preferred embodiment is to be applied to the patient, it is open completely, for example as shown in FIG. 1. The first step is to slide the patient's left arm 46 through sleeve 16. In doing this, the garment is moved up the patient's left arm 46 in a direction indicated by dashed arrow 48. Dashed arrow 49 has a split head indicating that front and rear panels 11*f* and 11*r*, respectively, of the body portion of the garment are passed around the front and back sides of the patient's thorax.

The dashed portion of arrow 50 indicates that the rear segment of neckband or collar 36 has already been passed around the back of the patient's neck and continued movement around the patient's neck is indicated by the solid portion of arrow 50. From FIG. 3, it should be noted that all of the above described steps may be easily accomplished without any substantial movement of either of the patient's arms 46 and 47.

Next, the lower portions of fastening strips 22 and 28 at lower edge 31 of the body of the garment have been wrapped around the patient's torso to join at the patient's left side. This movement is indicated by dashed arrows 51 and 52.

The remaining steps involve completion of the closing of the above described lower placket by bringing together fastening strips 21 and 27 to close the lower placket. Similarly, the upper placket is closed by bringing together fastening strips 19 and 25 and strips 20 and 26.

Finally, neckband flap 39 is wrapped around the back of collar 36 to be joined with fastening strip 38 (not shown in FIG. 3) in order to form a snug seal about the neck of patient 45. This movement is indicated by arrow 55.

From the foregoing description of application of the garment, it will again be appreciated that all of these steps may be accomplished without requiring any substantial movement of arms 46 or 47 of the patient. Thus, the garment may readily be applied to a patient without subjecting the patient to the conventional backward and upward movement of the arms necessary in order to put on a jacket of conventional construction.

As will be apparent to those skilled in the art, the above described sequence of closure of the upper and lower plackets is not essential to successful operation of the present invention. Naturally, in the preferred embodiment, sleeve 16 must first be applied to arm 46. However, once this is accomplished, it is the choice of the wearer, and the person assisting the wearer in putting on the garment, as to whether the lower placket is first closed as shown in FIG. 3, or whether the neckband flap 39 and the placket formed at the junctions of strips 19, 20, 25, and 26 is then closed, followed by closure of the lower placket.

In view of the foregoing description, other embodiments, and modifications to the present invention will suggest themselves to those skilled in the art. For example, it may be desirable to put some form of additional seal, such as a strip of rubberized material or soft plastic around upper edge 37 of collar 36 (FIG. 2). Also, a similar strip of sealing material may be applied to the interior of collar 36 in a modification which then allows the absorbant web panels 41 and 42 to commence absorbing water in an area below collar 36. While such a modification is within the scope of the present invention, the inventor believes that it is preferable to use a soft absorbant material in direct snug contact with the neck of the wearer rather than one which attempts to form a more watertight seal.

Also, it may be desirable to provide some form of flap of material (not shown) to cover the exposed edge of the upper placket consisting of strips 19, 20, 25 and 26 to prevent leakage of water therethrough during showering. In the preferred embodiment, the arrangement of absorbant web panels 41 and 42 is sufficient to absorb any small amounts of water which may leak through the matrix of the hook and eye fastening material which is exposed to shower water. Water which may enter the matrix at the seam between fastening strips 19 and 25 will flow down the user's arm.

Additionally, it is not necessary that the upper and lower plackets extend through the right hand sleeve in order to separate sleeve panels **18*f* and 18*r*. For example, a continuous placket may be provided to extend from lower edge 31 up to the lower portion of the armhole/sleeve area. The placket may then be extended around approximately half of the periphery of the armhole/sleeve area, and on up the body of the garment to the neck opening. Such an alternative embodiment still allows one side of the garment to open completely and would allow both of the user's arms to be simultaneously inserted into the two sleeves followed by subsequent closure of the placket and the neckband flap. It will therefore be appreciated that the splitting of one sleeve into two half sleeve panels corresponding to sleeve panels 18*f* and 18*r*** is not essential to the present invention.

Thus, it is within the scope of the present invention to provide a single continuous placket which extends from lower edge 31 up to the first point on the armhole/sleeve area of one sleeve. The only basic requirement is that the placket continue to a second point on or near the armhole/sleeve area and from there on through the neck opening to allow the neck and body to be completely open. It will readily be appreciated that the preferred embodiment meets this limitation since the armhole opening at the distal end of sleeve 17 may be considered a continuation of a single placket. However, such a placket may also be extended, for example, around the rear portion of the armhole seam area from a point in the armpit area of the armhole/sleeve area to a point where the top of the shoulder joins the armhole/sleeve area, and then on to the neck opening. Such an arrangement allows the entire side of the garment to be opened from lower edge 31 through neck opening 30 and the user could then slip both tubular sleeves over his or her arms at the same time while front panel **11*f*** of the body section of the garment was being raised onto the user.

Again, the preferred embodiment shown is believed preferable by the inventor. However, the alternative embodiment described immediately above is within the scope of the invention because it provides for a complete opening of one side of the garment from its lower edge through its neck opening, and allows the sleeves to be applied to the user without the requirement of any substantial upward or backward arm movement.

From the foregoing description of the preferred embodiment it will be appreciated that use of the present invention is not limited strictly to protection of thoracic incisions in the sternum area, although that is its preferred use and the need which gave rise to the present invention. For example, the location of lower edge 31 may be extended downwardly in an embodiment of the present invention which may also be conveniently used to protect an abdominal incision on a patient desiring to shower.

From the foregoing, it will be appreciated that the preferred embodiment of the present invention, and a number of possible alternative embodiments which will suggest themselves to those skilled in the art, overcome the drawbacks of the prior art described above and meet the objects of the invention recited herein. Therefore, the scope of the present invention is to be limited only by the claims below.

I claim:

1. A water resistant garment comprising in combination:

a body portion;

a first sleeve and a second sleeve;

a neck opening;

a neckband disposed around the periphery of said neck opening comprising a neckband flap for overlapping a first end of said neckband;

means for selectively joining said neckband flap and said first end of said neckband;

a lower placket extending from a lower edge of said body portion to the armhole/sleeve area of said first sleeve and longitudinally along the entire length of said first sleeve to a first point at the distal end thereof; and an upper placket extending from a second point at the distal end of said first sleeve to said neck opening;

whereby said body portion and said first sleeve may be completely open to allow said garment to be worn.

2. A garment as recited in claim 1, further comprising:

a web of water absorbing material disposed within said body portion below said neck opening.

3. A garment as recited in claim 1, further comprising:

means for forming a water resistant seal around the periphery of said neck opening.

4. A garment as recited in claim 1, wherein:

said upper and lower plackets comprise complementary strips of hook and eye fastener material.

5. A water resistant garment comprising in combination:

a body portion;

a first sleeve and a second sleeve;

a neck opening;

neckband disposed around the periphery of said neck opening comprising a neckband flap for overlapping a first end of said neckband;

means for selectively joining said neckband flap and said first end of said neckband;

a placket extending from a lower edge of said body portion to a first point at the armhole/sleeve area of said first sleeve and continuing to a second point on said armhole/sleeve area of said first sleeve, and further extending from said second point on said armhole/sleeve area of said first sleeve to said neck opening, said second point being spaced apart from said first point;

whereby said body portion and said first sleeve may be completely open to allow said garment to be placed on a user without requiring substantial movement of the arms of said user in backward and upward directions.

6. A garment as recited in claim 5, further comprising:

a web of water absorbing material disposed within said body portion below said neck opening.

7. A garment as recited in claim 5 further comprising:

means for forming a water resistant seal around the periphery of said neck opening.

8. A garment as recited in claim 5, wherein:

said placket is formed at a junction of complementary strips of hook and eye fastener material.

9. A water resistant garment as recited in claim 1 wherein said lower placket and said upper placket are each formed at respective junctions of edges having complementary strips of hook and eye fastener material affixed thereto.

* * * * *